US010946637B2

(12) United States Patent
Neger et al.

(10) Patent No.: US 10,946,637 B2
(45) Date of Patent: Mar. 16, 2021

(54) PRINTING PRESS, METHOD AND APPARATUS FOR CORRECTING A PRINTING POSITION OF A PRINTING UNIT

(71) Applicant: Siemens Aktiengesellschaft, Munich (DE)

(72) Inventors: Miriam Neger, Feucht (DE); Joerg Reh, Moehrendorf (DE)

(73) Assignee: Siemens Aktiengesellschaft, Munich (DE)

( * ) Notice: Subject to any disclaimer, the term of this patent is extended or adjusted under 35 U.S.C. 154(b) by 186 days.

(21) Appl. No.: 16/353,147

(22) Filed: Mar. 14, 2019

(65) Prior Publication Data

US 2019/0283396 A1 Sep. 19, 2019

(30) Foreign Application Priority Data

Mar. 14, 2018 (EP) ..... 18161741

(51) Int. Cl.
*B41F 13/02* (2006.01)
*B41F 33/00* (2006.01)
*B41F 13/12* (2006.01)

(52) U.S. Cl.
CPC ..... *B41F 13/025* (2013.01); *B41F 13/12* (2013.01); *B41F 33/0081* (2013.01)

(58) Field of Classification Search
CPC .... B41F 13/025; B41F 13/12; B41F 33/0081; B41P 2213/90
See application file for complete search history.

(56) References Cited

U.S. PATENT DOCUMENTS 5,193,727 A * 3/1993 Crowley ..... B41F 17/02 101/484
7,133,056 B2 * 11/2006 Tanaka ..... G03G 15/0131 347/116
7,343,110 B2 * 3/2008 Sakamoto ..... G03G 15/0194 399/301
10,210,626 B2 * 2/2019 Chiba ..... G06T 7/60
2006/0236885 A1 10/2006 Poulain et al.
2009/0283002 A1 11/2009 Schultze

* cited by examiner

*Primary Examiner* — Justin N Olamit
(74) *Attorney, Agent, or Firm* — Cozen O'Connor

(57) ABSTRACT

An apparatus, a printing press and method for correcting the printing position of a printing unit of a printing press that has at least one sensor unit, where the method includes the steps of detecting an actual position of at least one print mark via the sensor unit, where the print mark is printed onto a printing material via the printing unit, determining of a deviation of the detected actual position from a setpoint position, determining at least one difference value that characterizes the deviation, determining a buffer value from a number of basic values previously stored in a memory, determining a correction value by subtracting the buffer value from the difference value, storing the determined correction value in the memory as one of the basic values, and correcting the printing position based on the determined correction value.

13 Claims, 3 Drawing Sheets

PRINTING PRESS, METHOD AND APPARATUS FOR CORRECTING A PRINTING POSITION OF A PRINTING UNIT

BACKGROUND OF THE INVENTION

1. Field of the Invention

The invention relates to a printing press, method and apparatus for correcting a printing position of a printing unit.

2. Description of the Related Art

A printed product, such as a magazine, a newspaper or else a packaging, is as a rule produced via a printing press. Moreover, printing presses are also used in the case of functional printing and in the case of decorative printing. The printing press has at least one printing unit that therefore represents a module or component of the printing press. As a rule, the printing unit comprises a rubber-covered or impression cylinder and frequently, for example, an inking and/or dampening unit. If the printed product or the printed copy is to be in multiple colors, what is known as multiple color printing is used as the printing method. Here, a color separation into the individual printing colors occurs, because the printed image that is to be printed onto a printing material is separated into primary colors and special colors, in order to produce the printed product. Printing presses for multiple color printing therefore, as a rule, have a dedicated printing unit for each printing color. Thus, for example, in the case of four color printing, a separation into the colors cyan, magenta, yellow and black occurs. The colors of the printed image or the colorfulness of the printed image is effected by way of a combination of the printing colors. In conventional printing presses, a unit design is frequently used, i.e., the individual printing units are arranged behind one another.

In order to achieve as high a quality of the printed product as possible, the individual colors have to be printed over one another via the printing units in a fixedly predefined, in particular exact, position, with the result that the printed image is perceived to be particularly crisp. Print marks are used, in order for it to be possible to measure the position of the printing colors with respect to one another. As a result, what is known as a register that is also called a color register and describes a fit of the individual colors on top of one another during multiple color printing can be controlled. Thus, in the case of the multiple color printing, the process colors or printing colors are printed after one another and over one another and/or next to one another, and thus result in the complete printed image. If the printing colors are not printed exactly over one another and/or next to one another, the printed image appears blurred or non-crisp or has color shifts that have a quality-reducing effect.

It is said that the printed image is in register when the printing colors lie exactly above one another. If this is not the case, then it can be called what is known as a register error or out-of-register error. If the printing press is configured as a sheet-fed printing press, then this can be produced, for example, via imprecise transport of the sheet of the printing material through the printing press. Register problems can likewise occur, for example, in the case of a web-fed printing press. In order to bring the printed image into register, a register regulation is used, for which a respective additional information item, the print mark, is applied to the printing material by each printing unit. With the aid of the respective print mark, the position of the individual printed images that are printed in the respective color can be determined. Thus, what is known as a mark field is printed per printed copy, which mark field contains the individual print marks. In each mark field, the offset of the individual print marks in the longitudinal and/or lateral direction is measured by a sensor unit. As a rule, an error is then calculated from a setpoint position and an actual position of the print mark, where the error is then corrected. As a result of the arrangement of the individual printing units in the printing press, such as arranged in a row behind one another, the spacing of the sensor unit from a respective printing unit can be particularly great, in particular if only one sensor unit is arranged downstream of the last printing unit. This is termed an "end-of-line" arrangement, particularly great spacings being produced between the printing unit, i.e., the regulating position, and the sensor unit, i.e., the measuring position. Before a copy of the printed product that printed in the printing unit reaches the sensor unit, a number of further printed copies have as a rule therefore already been printed via the printing unit, where the printed copies are thereupon measured by the sensor unit in the sequence, in which they were printed. That is, the correction performed is not yet visible in the next measurement or the next measurements of the position of the print mark via the sensor unit.

If no additional measures are then undertaken, in order to implement the register regulation, the error that has already been corrected would be corrected again, which leads to overshooting and/or to instabilities in the regulation.

Two ways to solve the problem are known from the prior art. In the first way or the first type, a correction is no longer performed until the printed copy with the correction has arrived at the measuring point or the sensor unit. In the second type, boosting of the regulator is decreased, with the result that a correction value that regulates the printing position of the printed image in the printing unit is calculated, which correction value is smaller than the actual register error. The two conventional measures that are mentioned and used have the disadvantage, however, that a particularly slow regulating behavior occurs which, in particular, becomes slower, the greater a spacing becomes between the printing unit and the sensor unit, that is to say between the printing point and measuring point.

SUMMARY OF THE INVENTION

Consequently, it is therefore an object of the present invention to provide a method and an apparatus, via which a register regulation can be performed particularly advantageously, and therefore printed images with a particularly high quality can be realized.

This and other objects and advantages are achieved in accordance with the invention by a method for correcting a printing position of a printing unit. Here, the printing unit is a component or a part of a printing press that has at least one sensor unit. The printing press can produce, for example, a printed product via flexographic printing, gravure printing, screen printing, digital printing or offset printing. The printing press can be, for example, both a printing press for web-fed printing and a printing press for sheet-fed printing. In principle, the printing press can be any desired printing press.

In order for it then to be possible to particularly advantageously correct the printing position of a printing unit, i.e., the position of a printed image or printed motif that is printed onto a printing material for producing a printed copy or a printed product, the method comprises a plurality of steps, where in a first step or method step, an actual position of at least one print mark that is printed onto the printing material via the printing unit is detected by the sensor unit. That is, the sensor unit is configured, for example, via a sensor to detect the actual position of the printed print mark on the printing material. In a second step of the method, a deviation of the detected actual position from a setpoint position is determined. In other words, the deviation corresponds to an offset, in particular in the longitudinal direction and/or transverse direction of the actual position of the print mark with respect to the position that is required, in particular for a particularly high quality of the printed product. In a third step of the method, at least one difference value that characterizes the deviation is determined. The difference value can be, for example, a spacing between the setpoint position and the actual position. In addition to the spacing, i.e., the length of the spacing, the difference value can have, for example, a directional value. Thus, the difference value can also be represented, for example, as a vector, the magnitude of which is the spacing between the setpoint position and the actual position. In a fourth step or method step, a buffer value is determined from a number of basic values that were previously stored in a memory.

The memory is, for example, a memory area of an electronic computing device, in which memory area a plurality of values, in particular basic values, are storable or can be stored. In the case of a first performance of the method, i.e., when it is performed for the first time, the basic values that are stored in the memory are each defined, for example, individually to read zero. The first performance of the method can be performed, for example, in the case of starting up of a print job or the like. The memory is preferably configured as a buffer memory, i.e., it serves for buffer storage of the basic values and not for permanent storage of the basic values. In a fifth step of the method, a correction value is determined, by the buffer value being subtracted from the difference value. In a sixth step, the determined correction value is stored as one of the basic values in the memory, i.e., the correction value is stored in the memory, with the result that it can be used in the case of a renewed performance of the method for forming or determining the buffer value. Finally, in a seventh step of the method, the printing position is corrected based on the determined correction value. That is, the printing unit is manipulated such that the printing position of the printed image to be printed is changed on the printing material, in particular such that the actual position has been changed by at least the correction value in the case of a future print. As a result, a regulating difference is changed that represents the difference between the setpoint position and the currently measured actual position.

In other words, the described method can achieve a situation where each individual measured value, detected by the sensor unit, of the respective actual position can be used for the correction, and therefore a respective register correction can occur in the case of each printed copy. To this end, each current correction value determined during the performance of the method is input into the memory. In the case of a renewed performance of the method, the current regulating difference and the correction that is already on the course can be taken into consideration during the determination or calculation of the new, more current correction value. Here, the course is to be understood to mean the path between the printing unit and the sensor unit, whereby the "correction which is on the course" is to be understood to mean the at least one former correction value that is stored as a basic value in the memory.

The respective basic value is formed from a previous correction value that was determined in a previous performance of the method. That is, if the method in accordance with the invention is performed, for example, at least a second time, then the correction value of the first performance becomes the basic value of the second performance. If the method is repeated so often that the number of repetitions corresponds to the number of basic values that are stored in the memory, then the memory is filled completely with each basic value formed from a correction value of one of the previous performances of the method. An initialization of the basic values with in each case one predefined value, such as in the case of a new print job, serves to perform the method until the basic values can be formed in each case from a correction value.

By way of the described method, each actual position that is detected via the sensor unit can be used for the register regulation and therefore for the correction. As a result, the register correction, i.e., the correction of the printing position, can occur in the case of each printed copy, i.e., in the case of each individual printed product that is printed via the printing unit and is conveyed or moved through the printing press as far as the sensor.

As a result of the spacing between the printing unit and the sensor unit, what is known as a dead time (also called a running time or transport time) occurs between the printing of the print mark and the detection thereof. The dead time is dependent on the known spacing between the printing unit and the sensor unit. As a result, the dead time can also be called a dead travel. As a result of the dead travel, a correction that has already been performed is not yet visible in the currently detected actual position. The correction or the associated correction value is input in the memory, however. If the method is then re-performed, the at least one current correction value of the performed correction is then taken into consideration in the case of the determination of a new correction value. For example, the correction can be performed in a defined area, with the result that the correction does not distort the print marks.

A particularly advantageous register regulation for correcting the printing position of the printing unit can be realized via the method in accordance with the invention, in particular in the case of great spacings between the printing unit and the sensor unit. Here, the register regulation can operate particularly dynamically and stably, as a result of which, for example, overshooting can be avoided.

In one advantageous embodiment of the invention, the basic value that has been stored the longest in the memory in relation to the basic values that are stored in the memory is deleted from the memory and is replaced by the determined correction value. As has already been mentioned, the memory can have basic values that are each initialized to read zero in the case of a first performance of the method. Moreover, the memory locations in the memory, i.e., the areas, in which in each case one basic value is deposited or can be deposited, have a fixed relationship with respect to a temporal sequence. Therefore, the basic values that are formed, in particular, from in each case one old correction value or correspond to the latter can be read from the memory such that the temporal sequence of their input into the memory can be detected. If a first correction value is then input as a new basic value into the memory, the correction value that was input last, before the first correction value, moves from a first memory location further to a second memory location. Here, a correction value that lies at the last memory location is deleted or output from the memory and is occupied by the basic value of the penultimate memory location, which basic value therefore becomes the last basic value of the memory in the case of the input of the new basic value. By way of the basic value stored the longest in the memory being deleted or pushed out of the memory and the currently determined correction value being added as a new basic value, a current number of basic values which are formed, in particular, from respective correction values that were generated in each case during a performance of the method in accordance with the disclosed embodiments of the invention can be stored in the memory, with the result that the correction of the printing position can be performed particularly efficiently and/or particularly precisely. When the method has been repeated so often that the number of repetitions corresponds to the number of memory locations in the memory, the memory is filled completely with the respective most current basic values.

In another advantageous embodiment of the invention, the memory which can also be called a buffer is configured as a shift register. In a shift register, the number of existing memory locations, in which in each case one basic value can be stored, is constant. During each writing operation of the shift register, a basic value is shifted further by one memory location, with the result that the individual value that was written or stored first leaves the memory first. Here, pushing in and out or inputting and outputting occur as a rule synchronously. As a result of the use of the shift register as a memory during the performance of the method, the method can be performed in a particularly advantageous way, because the respective correction values that are input as basic values into the memory or shift register can be used particularly simply for the determination of the respective current correction value.

In a further advantageous embodiment of the invention, the number of basic values that are stored in the memory is determined via a spacing between a printing location of the print mark in the printing unit and a reading position of the sensor unit. Furthermore, the number is determined via a format length of the printing material. Here, the number is advantageously the rounded-up quotient of the spacing and the format length. The format length is the length that the printing material has along the direction, along which the printing material can be transported or is transported through the printing press and, in particular, through the printing unit. In other words, the number of basic values that are stored in the memory corresponds to the number of following printed copies: the printed copy, the print mark of which is detected via the sensor unit at a time, the printed copy that is printed via the printing unit at the time, and the printed copy or the printed copies that is/are situated in the printing press at the time and has/have already been printed via the printing unit at the time, but has/have not yet been detected via the sensor unit. The respective current correction value can be calculated in a particularly dynamic manner via the number of the printed copies that corresponds to the number of basic values that are stored in the memory. Furthermore, for example, overshooting can be avoided, because the regulating difference, the difference between the setpoint position and the actual position, on account of the dead time or the dead travel, can be compensated for by way of the number of stored basic values, or the basic values are taken into consideration during the correction of the printing unit. Here, in particular, the number of printed copies that have already been printed but the respective print mark of which has not yet been detected is to be understood to mean that number which, in the case of continuous operation of the printing press, corresponds to the number of printed copies that are currently situated on the path from the printing unit, such as via a conveying device, to the sensor unit.

In another advantageous embodiment of the invention, a plurality of actual positions of respective print marks that are printed onto respective printing materials via the printing unit are detected via the sensor unit, where an actual position mean value is formed from the plurality of actual positions, and the difference value is determined via the actual position mean value. In other words, the actual position is smoothed or averaged. As an alternative, a plurality of actual positions of respective print marks that are printed onto respective printing materials via the printing unit are detected via the sensor unit. Here, the respective deviations of the detected actual positions from those of the setpoint positions are determined, where respective deviation values that characterize the respective deviations are determined. The difference value that is used to form the correction value can be determined from the actual position mean value or from the mean value of the deviation values. Here, a number of printed copies, from which the actual position mean value or the mean value of the deviation values is formed, can be termed what is known as filter depth. Therefore, the filter depth corresponds to the number of actual positions that are used to form the actual position mean value. A variation, in particular because of measuring technology, during the detection of the actual position can be compensated for, for example, via the averaging or mean value formation of the actual positions or the deviation values.

In an advantageous embodiment of the invention, the number of basic values that are stored in the memory corresponds to the sum of a first number and a second number. The first number is determined via the spacing between the printing location and the reading position, and/or the format length of the printing material. Here, the first number is advantageously the rounded-up quotient of the spacing and the format length. The second number corresponds to the number of actual positions that are used to form the actual position mean value and therefore the filter depth. In other words, the number of basic values that are stored in the memory corresponds to the sum of a first number and a second number. Here, the first number is the number of following printed copies: the printed copy, the print mark of which is detected via the sensor unit at a time, the printed copy that is printed via the printing unit at the time, and the printed copy or the printed copies that is/are situated in the printing press at the time and has/have already been printed via the printing unit at the time, but has/have not yet been detected via the sensor unit. The second number of the sum, the sum describing the number of memory locations, corresponds to the number of actual positions that are used to form the actual position mean value, i.e., the filter depth. This is based on the fact that the dead time or the dead travel is extended for the case of the mean value formation. If the correction of the printing position of the printing unit is regulated via an averaged or smoothed actual position, or a predefined filter depth, and the extended dead travel is not taken into consideration, this can lead to an incorrect calculation of the correction and therefore to an unstable behavior of the regulation. By way of the expansion of the number of memory locations by the second number, the number of actual positions that are used to form the actual position mean value, in the memory or shift register, the correction is made more precise and/or the filter depth is taken into consideration during the correction, with the result that an unstable behavior of the regulation can be ruled out.

In a further advantageous embodiment of the invention, the buffer value is determined as the sum of the basic values. That is, the basic values that are deposited or stored in the memory and represent or are, in particular, the correction values that were defined at an earlier time, i.e., in the case of an earlier performance of the method, are added, as a result of which the buffer value is formed or determined. A respective current correction value can be determined particularly rapidly via the formation of the sum and the subtraction of the sum as a buffer value from the difference value and, for example, overshooting of the correction of the printing position of the printing unit can be kept particularly low.

In another advantageous embodiment of the invention, at least one of the basic values is weighted during the determining of the sum. That is, at least one of the basic values is multiplied, in particular, by a scalar, with the result that the basic value has a particularly great or a particularly small influence on the determination of the correction value in comparison with the other basic values. Thus, for example in the case of the use of the abovementioned filter depth and therefore the expansion of the memory locations of the memory by the second number, in each case the last basic values can be weighted. Here, the last basic values are to be understood to mean the basic values that have already been passed through the memory, with the result that they lie in the last memory locations before leaving the memory, with the result that the last basic values fall out of the memory in the case of the input of a second number of new correction values. That is, the method is repeated so often that the number of the repetition corresponds to the second number, and the last basic values are therefore removed from the memory, in each case only the basic value that is situated in the last memory location always dropping out of the memory per performance of the method. If the filter depth is three, for example, the last basic value can be weighted with 0, the penultimate basic value can be weighted with ⅓, and the third-last basic value can be weighted with ⅔. As a result, the mean value formation that is defined via the filter depth can be taken into consideration in the case of the correction in a particularly advantageous way.

In yet another advantageous embodiment of the invention, the sensor unit has a camera sensor and/or a fiber optic system. With the camera sensor, for example, the print mark can be detected in a particularly advantageous way and, in particular, can be read for subsequent processing. Furthermore or as an alternative, light that is reflected by the print mark can be guided via a fiber optic system in a particularly advantageous way to a suitable sensor of the sensor unit, with the result that the light can be detected. Furthermore, the sensor unit can be arranged relatively freely on or in the printing press as a result of the use of a fiber optic system. As an alternative or in addition, the respective print mark can be detected via other technologies, such as a contrast scanner. The sensor unit should be configured such that it can provide sensor data, from which the actual position can be determined or can be detected via the method in accordance with the disclosed embodiments of the invention.

In another advantageous embodiment of the invention, paper and/or cardboard and/or plastic and/or metal and/or wood and/or glass are/is used as the printing material. Here, the printing material can be configured, for example, as a foil or film, i.e., the material that at least partially forms the printing material, in particular, for example, plastic and/or metal, can be of particularly thin configuration. Furthermore, the method can be applied in the case of further materials that are suitable for printing, with the result that the method can be performed for a particularly great range of printing presses and can therefore be realized for a particularly great number of different printed products. In this way, the method in accordance with the disclosed embodiments of the invention can be applied in the case of a multiplicity of printed products, and the correction of the printing position can therefore be performed particularly efficiently.

It is also an object of the invention to provide an apparatus for correcting a printing position of a printing unit of a printing press, having at least one electronic computing device that is configured to detect an actual position of at least one print mark that is printed onto a printing material via the printing unit, based on sensor data that are received by a sensor unit. Furthermore, the electronic computing device is configured to determine a deviation of the detected actual position from a setpoint position, at least one difference value that characterizes the deviation, a buffer value from a number of basic values that were previously stored in a memory, and a correction value, by subtraction of the buffer value from the difference value. Furthermore, the electronic computing device is configured to store the correction value as one of the basic values in a memory, and to provide a signal for the correction of the printing position based on the determined correction value, where it is possible for the printing position of the printing unit to be corrected via the signal.

It is also an object of the invention to provide a printing press that comprises the apparatus in accordance with the invention for correcting a printing position of a printing unit.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention will be described in greater detail in the following text using diagrammatic drawings, in which.

DETAILED DESCRIPTION OF THE EXEMPLARY EMBODIMENTS

Figure 1:
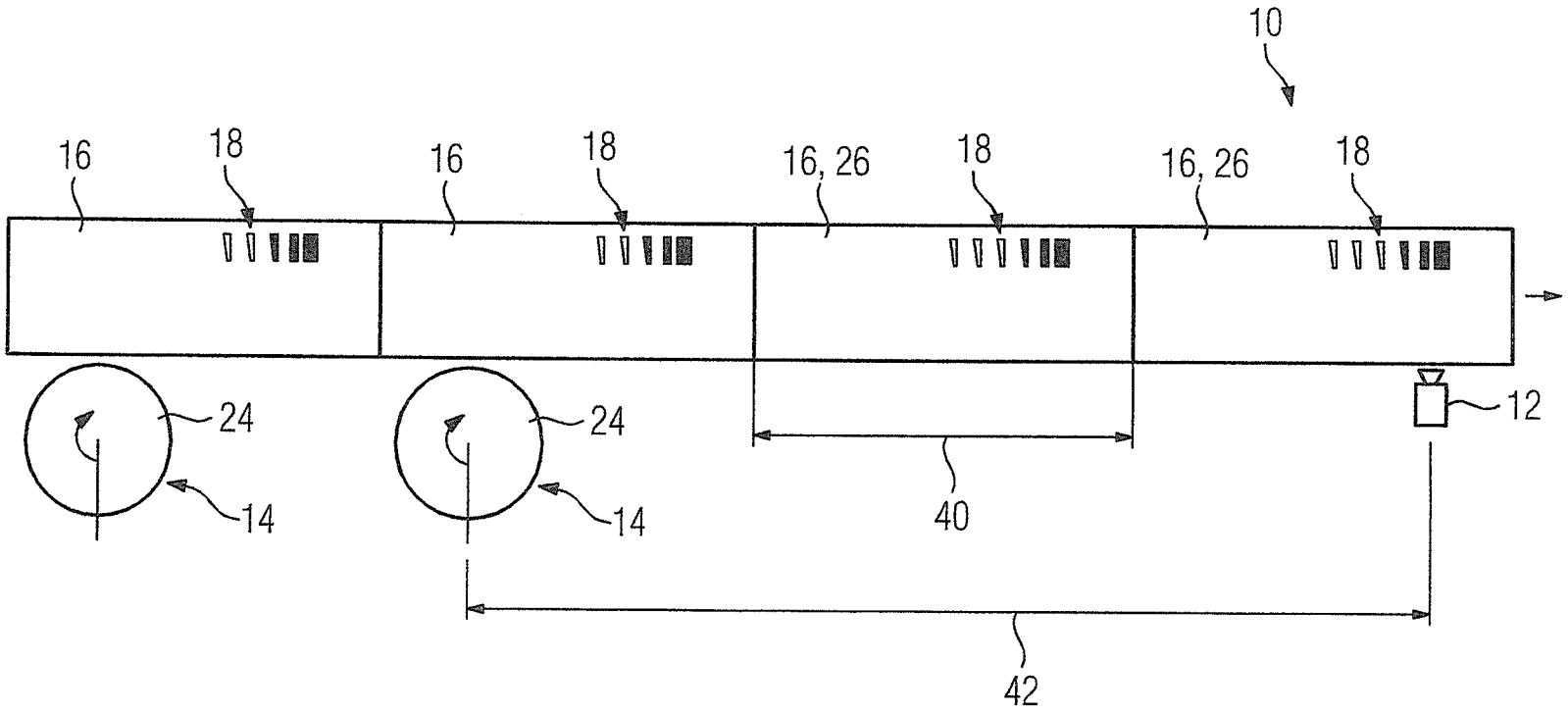
FIG. 1 shows a diagrammatic view of a printing press which has a sensor unit and at least one printing unit in accordance with the invention.

FIG. 1 shows a diagrammatic view of a printing press 10 that has a sensor unit 12 and at least one printing unit 14. What are known as register errors can occur, in particular, in the case of multiple color printing, in which a printed image is separated into primary colors, where each printing unit 14 prints one of the primary colors onto a printing material 16. In the case of a register error, the individual printing colors do not lie exactly above one another, with the result that the finished printed copy or printed product appears to be, for example, blurred. The register error can be compensated for in a particularly dynamic and therefore efficient manner via the proposed method, as a result of which the printed image and therefore the finished printed copy or its individual colors are in register.

The method for correcting the printing position of the (in particular, respective) printing unit 14 of the printing press 10 which has at least the sensor unit 12 comprises a plurality of steps, where in a first step of the method, an actual position of at least one print mark 18 that is printed onto the printing material 16 via the printing unit 14 is detected via the sensor unit 12. In a second step, a deviation of the detected actual position from a setpoint position is determined. In a third step, at least one difference value that characterizes the deviation is determined. In a fourth step, a buffer value is determined from a number or plurality of basic values 22 that were previously stored in a memory 20. In a fifth step, a correction value is determined by subtracting the buffer value from the difference value. In a sixth step, the correction value that is determined in the fifth step is stored in the memory as one of the basic values 22. In a seventh step, the printing position of the printing unit 14 is corrected based on the determined correction value.

The printing press 10 can print, for example, packaging via what is known as flexographic printing, for example. Moreover, the printing press 10 can also be a printing press that is configured for offset printing. Furthermore, the printing material 16 or the printing materials 16 can be printed via, for example, web-fed printing or sheet-fed printing. In order for it to be possible for the printing material 16 to be printed particularly advantageously, the respective printing unit 14 advantageously has in each case at least one impression cylinder 24. Depending on the type of printing method or the printing press 10, the respective printing unit 14 can have, for example, a print head instead of the impression cylinder 24, as can be the case in digital printing, for example.

The respective printing color can be applied to the printing material 16 in a particularly advantageous way via the respective impression cylinder 24 of the respective printing unit 14. Here, the printing material 16 is advantageously paper, cardboard, plastic and/or metal, as a result of which a particularly great variety of different printed products can be produced via the printing press 10. In the exemplary illustrated embodiment, the printing press 10 has two printing units 14 that are arranged behind one another. One form of multiple color printing is what is known as four color printing, in the case of which, in particular, the colors cyan, magenta, yellow and black are used to produce colored printed products. In the case of four color printing, four printing units 14 would therefore be provided, but only two printing units 14 are shown in FIG. 1 for the sake of simplicity. In the case of the method, the number of printing units 14 of the printing press 10 can be selected freely. The sensor unit 12 advantageously has a camera sensor and/or a fiber optic system, as a result of which the respective print mark 18 is detectable or can be detected particularly simply by the sensor unit 12.

FIG. 1 additionally shows that a spacing between the printing units 14 and the sensor unit 12 has a defined length. This length can be, for example, the length of two printing materials 16, as shown in FIG. 1. This leads to a dead time, i.e., the print mark 18 that is detected by the sensor unit 12 at a first time has already been printed at an earlier second time. Conversely, the print mark 18 that is printed at the first time is only detected by the sensor unit 12 at a later third time. The spacing between the first time and the second or third time is called the dead time. This can also be interpreted or understood to mean a dead travel. Thus, in the printing press 10 of FIG. 1, the printing materials 16 to be printed run from the left one after another first of all via the first printing unit 14 and then via the second printing unit 14, and finally arrive behind one another and therefore after one another at the sensor unit 12. In the exemplary illustrated embodiment, a printed copy 26 is arranged between the printing unit 14 that prints last (the right hand printing unit 14 of FIG. 1) and the sensor unit 12 in the printing press 10. That is, by the time the sensor unit 12 sees a printed print copy 26 or the printing material 16 that has been printed via the printing unit 14 that prints last, two further printed copies 26 have already been printed via the printing unit 14.

The respective print mark 18 can be formed from individual rectangles or triangles, as shown in the example, where at least one rectangle or at least one triangle, in particular, is provided for each color to be printed. The method is fundamentally independent of the shape of the print marks 18. For the method, measured values have to be available merely at a defined time. In the exemplary embodiment, the printing unit 14 that prints last is configured to print the triangle of the print mark 18, where the triangle lies on the left in FIG. 1. As an alternative or in addition, in particular according to the type of sensor unit 12, the print marks can be, for example, dots in the respective printing color. Thus, the rectangular and triangular configuration of the print marks 18 or the mark fields has established itself for a fiber optic detection of the print mark, with the result that they are configured as wedge or block marks, whereas what are known as dot marks are frequently used for camera-based sensor units 12.

Figure 2:
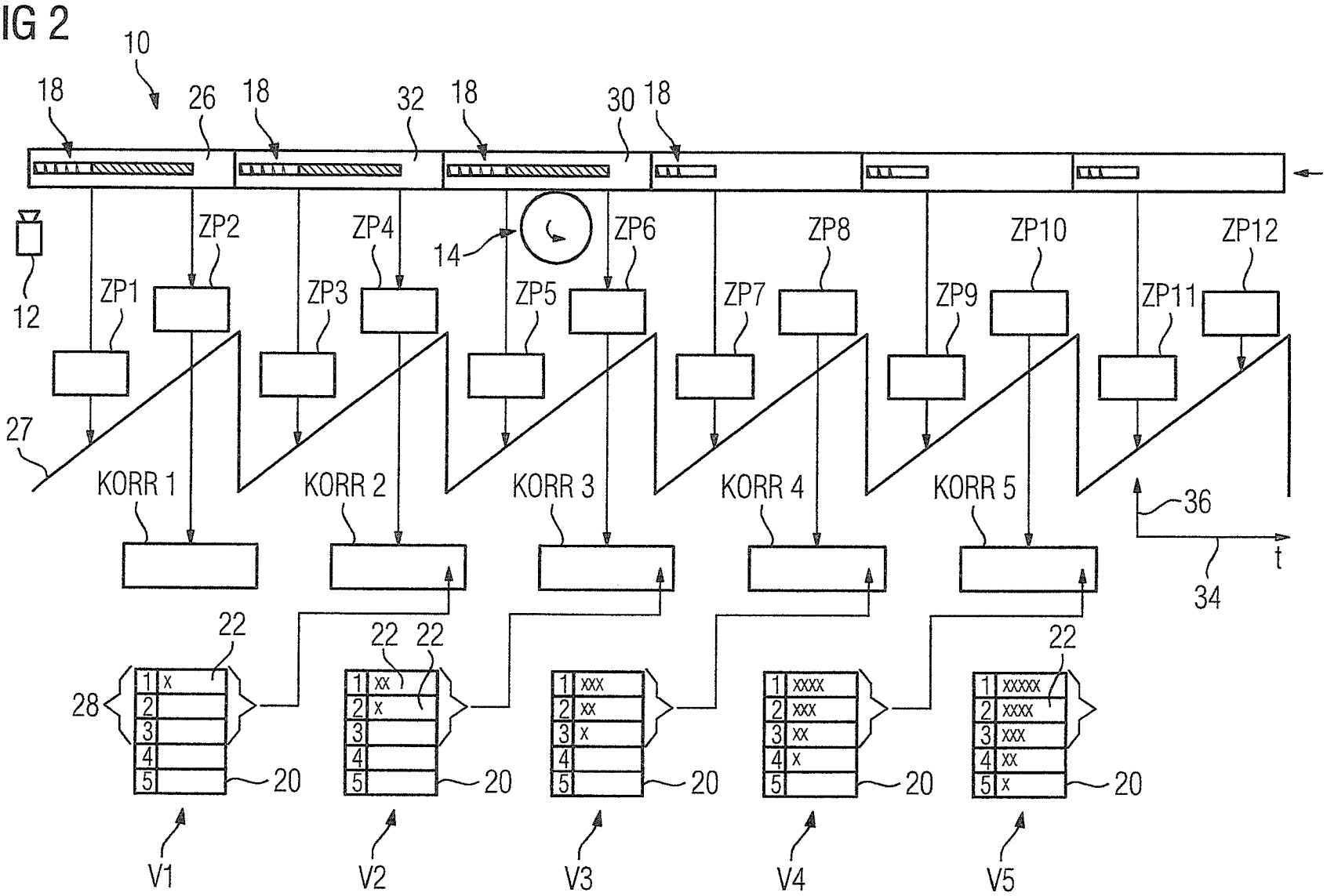
FIG. 2 shows a diagrammatic flow chart of one exemplary embodiment of a method for correcting a printing position of at least one of the printing units of the printing press in accordance with the invention.

FIG. 2 shows a diagrammatic flow chart of one exemplary embodiment of the method for correcting the printing position of the (in particular, respective) printing unit 14 of the printing press 10. The memory 20 is advantageously configured as a shift register, with the result that a basic value that is written into the memory 20 is passed through the memory or shift register when a further basic value 22 is again added, and leaves it after a last memory position of the memory 20 is reached. A fixed temporal relationship of the basic value 22 with the respective detection time, such as the first time, can be established in a particularly simple way via the use of a shift register, as a result of which a temporal sequence of the basic values 22 can be realized in the memory 20. Therefore, the basic value 22 that has been stored the longest in the memory 20 in relation to the basic values 22 that are stored in the memory 20 can be deleted from the memory in a particularly advantageous way and can be replaced by the correction value that is determined via the current repetition of the method as a new or current basic value 22. In particular, as a result of the configuration of the memory 20 as a shift register, there is an attribution between one of the memory positions and a temporal sequence of the repetitions of the method.

In the diagrammatic illustration of the method which is shown in FIG. 2, the respective individual printed copies 26 or printing materials 16 are printed via the printing unit 14, coming from the right and following one another, and the print marks 18 are subsequently detected via the sensor unit 12. Here, the sawtooth-like line 27 indicates the respective position of a master axis of the printing unit 14 or the impression cylinder 24. That is, the master axis has arrived back in its original position after one complete revolution of the impression cylinder 24.

The method is performed for the first time when the first printed copy 26 or its print mark 18 is detected via the sensor unit 12. Here, the memory 20, the memory size 28 of which comprises a number of three memory locations in the example which is shown, which is shown via the left hand curly bracket, corresponds to the number that is predefined, inter alia, via the spacing or the dead travel between the printing unit 14 and the sensor unit 12. Here, the number is defined via the number of following printed copies 26, 30, 32: the printed copy 26, the print mark 18 of which is detected via the sensor unit 12 at a time, the further printed copy 30 that is printed via the printing unit 14 at the time, and the printed copy 32 or the printed copies 32 that is/are situated in the printing press 10 at the time and has/have already been printed via the printing unit 14 at the time, but has/have not yet been detected via the sensor unit 12. In other words, the number of basic values 22 that are stored in the memory is defined via a spacing 42 between a printing location of the print mark 18 in the printing unit 14 and a reading position of the sensor unit 12. Furthermore, the number is defined via a format length 40 of the printing material. Here, the number is the rounded-up quotient of the spacing 42 and the format length 40.

A time axis 34 is defined with respect to the line 27 that determines the position of the master axis. The position of the master axis is shown in a second axis 36 that is perpendicular with respect thereto. Thus, the first print mark of the first printed copy 26 is detected at the first time ZP1, where the basic values 22 of the memory are all fixed as 0 at the time. This represents the first step of the method, where the first step is performed at the time ZP1 in the illustrated example. This is followed in the second step by the determination of the deviation of the detected measured position of the print mark 18 from the setpoint position. In the third step, a difference value that characterizes the deviation is determined from the deviation. In the next fourth step, a buffer value is determined from a number of basic values 22 that were previously stored in the memory 20. During the first performance of the method, in which the memory 20 is situated in the state V1, the buffer value is 0, because no correction has yet been performed before the first performance of the method. In a next fifth step of the method, the correction value is formed from the buffer value by subtracting the buffer value from the difference value. Thereupon, in the sixth step of the method, the determined correction value is stored as one of the basic values 22 in the memory 20.

At the time ZP2, the first correction value KORR1 is stored in the memory, and the third print mark 18, i.e., the print mark 18 of the printed copy 30, is printed but has not yet been measured. In the case of a renewed performance of the method at the time ZP3 or directly following the time ZP3, the steps of the method are re-performed, with the result that a new correction value KORR2 was written or is written into the memory 20 as a new basic value 22 at the time ZP4, at which the fourth print mark 18 was printed on a further printed copy. At the time ZP5, the third print mark 18, i.e., the print mark of the printed copy 30, is measured, and the method is re-performed for a third time, with the result that the correction value KORR3 has already been input into the memory 20 at the time ZP6, at which a fifth print mark 18 is printed. At the time ZP7, the print mark 18 that is printed fourth is detected, and the method is re-performed, with the result that the fourth correction value KORR4 has already been input into the memory 20 at the time ZP8, at which the sixth print mark 18 is printed. Here, the memory 20 is filled for the first time with basic values 22 that are formed via earlier performances of the method and are formed from the correction values KORR1 to KORR3, with the result that the correction value KORR1 that was written into the memory at the time ZP1 or time ZP2 is expelled from the memory area 28. At the times ZP9 and ZP11, the method is started in each case again, since the first method step is performed at the respective time. In each case at the time ZP10 or time ZP12, the method has been performed completely, and a further print mark 18 is printed in each case.

The buffer value is formed from the sum of the basic values 22 that are stored in the memory 20 with the memory size 28 and are formed from respective correction values (KORRn to KORRn+2) for a respective performance of the method. The buffer value that is updated before each performance of the method is subtracted from the respective current difference value that characterizes the deviation. The memory size 28 is also called the memory depth.

As an alternative, the method can be performed such that a plurality of actual positions of respective print marks 18 that are printed onto respective printing materials 16 via the printing unit 14 are detected via the sensor unit 12, where an actual position mean value is formed from the plurality of actual positions, and the difference value is determined via the actual position mean value. Thus, for example, in the case of three different printed copies, such as the printed copies 26, 30 and 32, the actual positions can initially be detected and averaged, and the deviation of the setpoint position from the averaged actual position or the actual position mean value can be determined. Here, this is called a filter depth that corresponds in the example to three, i.e., the number of print marks 18 that are checked and used to form the mean value. Therefore, the filter depth is identical to the number of actual positions that are used for the formation of the actual position mean value. If a difference value or actual position mean value of this type that is smoothed via the mean value formation is used in the method, or if it is used for the method, the memory size 28 is advantageously increased, i.e., the number of memory locations that can be stored in the memory 20 is increased by the number of actual positions that are used for the formation of the actual position mean value. The additional basic values 22 are advantageously taken into consideration in a weighted manner during the determination of the buffer value via the sum of the basic values 22.

If smoothed deviation values are used, basic values 22 that are taken into consideration via the weighting during the formation of the buffer value can be additionally stored via the extended memory size 28 of the memory 20 that is configured as a shift register. Thus, a faulty deviation can be capable of being avoided during the correction of the printing position, because the dead time or the dead travel is extended via the mean value formation of the actual position mean value. Therefore, with the method, a regulation of print marks 18 via a memory 20 that is configured, in particular, as a shift register can be performed in a particularly efficient and/or dynamic way and therefore lead to printed copies 26, 30, 32 that are printed particularly exactly in quality terms, where it is possible for smoothing of the actual position to be performed.

Figure 3:
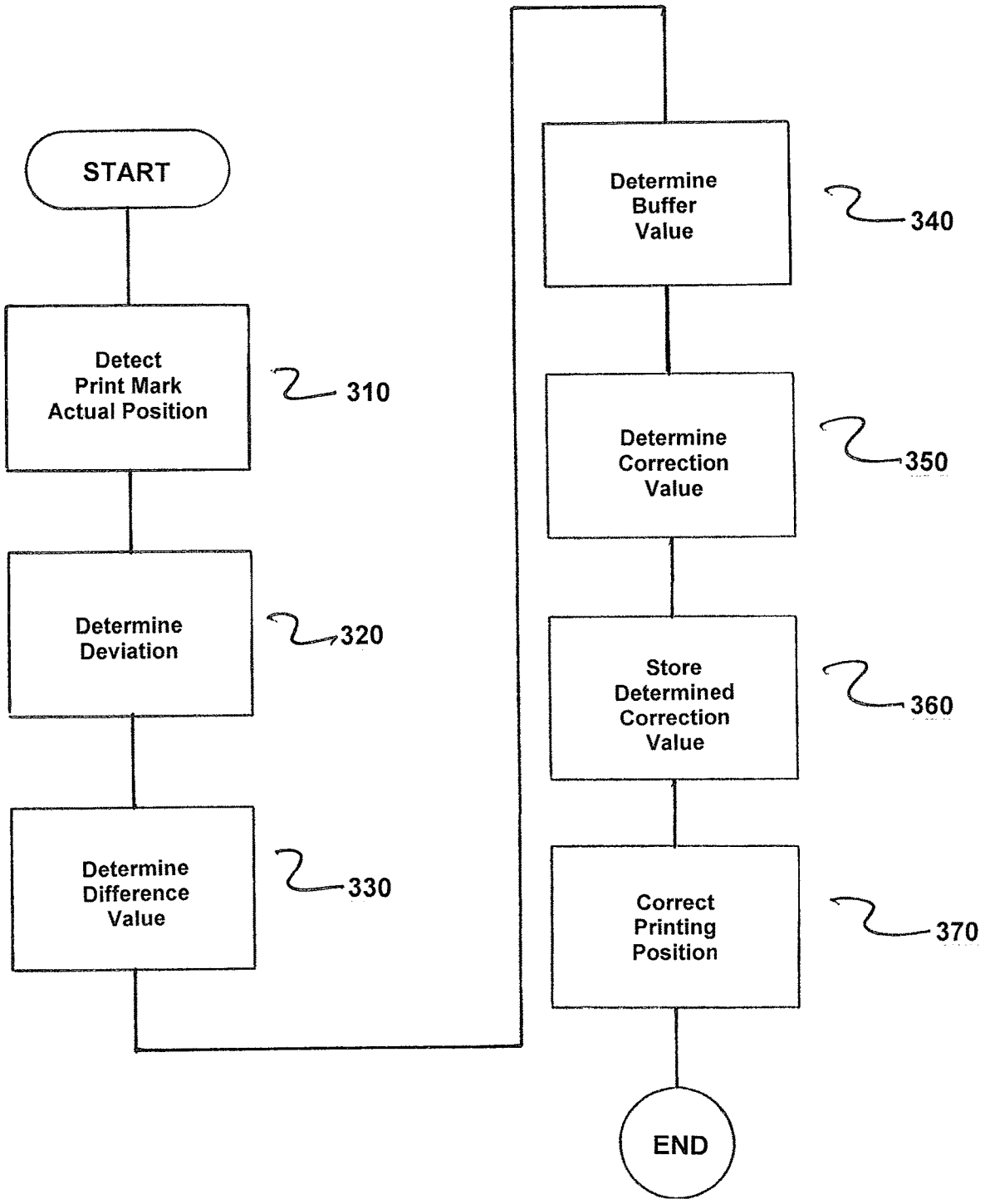
FIG. 3 is a flowchart showing the steps of the method in accordance with the invention.

FIG. 3 is a flowchart of the method for correcting a printing position of a printing unit 14 of a printing press 10 that includes at least one sensor unit 12. The method comprises detecting an actual position of at least one print mark via the sensor unit 12, as indicated in step 310. Here, the print mark 18 is printed onto a printing material 16 via the printing unit 14.

Next, a deviation of the detected actual position from a setpoint position is determined, as indicated in step 320. At least one difference value that characterizes the deviation is now determined, as indicated in step 330.

Next, a buffer value from a number of basic values 22 that were previously stored in a memory 20 is determined, as indicated in step 340.

Next, the buffer value is subtracted from the difference value to determine a correction value, as indicated in step 350.

The determined correction value is now stored in the memory 20 as one of the basic values 22, as indicated in step 360.

The printing position is now corrected based on the determined correction value, as indicated in step 370.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for correcting a printing position of a printing unit of a printing press which includes at least one sensor unit, the method comprising:

detecting an actual position of at least one print mark via the sensor unit, said print mark being printed onto a printing material via the printing unit;

determining at least one difference value which characterizes a deviation of the detected actual position from a setpoint position;

determining of a buffer value from a number of basic values which were previously stored in a memory;

subtracting the buffer value from the difference value to determine a correction value;

storing the determined correction value in the memory as one of the basic values; and correcting the printing position based on the determined correction value.

2. The method as claimed in claim 1, wherein the basic value having a longest period of storage in the memory in relation to the basic values which are stored in the memory is deleted from the memory and replaced by the determined correction value.

3. The method as claimed in claim 1, wherein the memory is configured as a shift register.

4. The method as claimed in claim 2, wherein the memory is configured as a shift register.

5. The memory as claimed in claim 1, wherein the number of basic values which are stored in the memory is determined by at least one of (i) a spacing between a printing location of the at least one print mark in the printing unit and a reading position of the sensor unit and (ii) a format length of the printing material.

6. The method as claimed in claim 1, wherein a plurality of actual positions of respective print marks which are printed onto respective printing materials via the printing unit are detected via the sensor unit, an actual position mean value being formed from the plurality of actual positions, and the difference value being determined via the actual position mean value.

7. The method as claimed in claim 6, wherein the number of basic values which are stored in the memory corresponds to a sum of a first number and a second number, the first number being determined by at least one of (i) the spacing between the printing location and the reading position and (ii) the format length of the printing material, the second number corresponding to a number of actual positions which are used to form the actual position mean value.

8. The method as claimed in claim 1, wherein the buffer value is determined as a sum of the basic values.

9. The method as claimed in claim 8, wherein at least one basic value of the basic values is weighted during said determination of the sum.

10. The method as claimed in claim 1, wherein the at least one sensor unit includes at least one of (i) a camera sensor and (ii) a fiber optic system.

11. The method as claimed in claim 1, wherein the printing material comprises at least one of (i) paper, (ii) cardboard, (iii) plastic, (iv) metal, (v) wood and (vi) glass.

12. An apparatus for correcting a printing position of a printing unit of a printing press, the apparatus comprising:

at least one electronic computing device which is configured to:

detect an actual position of at least one print mark which is printed onto a printing material via the printing unit, based on of sensor data which are received by a sensor unit;

determine at least one difference value which characterizes a deviation of the detected actual position from a setpoint position;

determine a buffer value from a number of basic values which were previously stored in a memory;

subtract the buffer value from the difference value to determine a correction value;

store the correction value in a memory as one of the basic values; and provide a signal for correction of the printing position based on the determined correction value.

13. A printing press having the apparatus as claimed in claim 12.

* * * * *